US007367545B1

(12) United States Patent
Chen

(10) Patent No.: US 7,367,545 B1
(45) Date of Patent: May 6, 2008

(54) MULTIPURPOSE LEVER TYPE TOOL

(76) Inventor: Yung-Shou Chen, 2F-1, No. 51, Sec. 3, Chung Yang Rd., Chung Ho Tsuen, Long-Ching Town, Taichung Hsien (TW)

( * ) Notice: Subject to any disclaimer, the term of this patent is extended or adjusted under 35 U.S.C. 154(b) by 0 days.

(21) Appl. No.: 11/733,320

(22) Filed: Apr. 10, 2007

(51) Int. Cl.
*B66F 15/00* (2006.01)

(52) U.S. Cl. ..... 254/25; 254/21; 7/139; 7/166

(58) Field of Classification Search ..... 254/25, 254/21, 133 R, 134; 7/139, 166
See application file for complete search history.

(56) References Cited

U.S. PATENT DOCUMENTS 5,237,715 A * 8/1993 Bane, III ..... 7/139
5,845,354 A * 12/1998 Long et al. ..... 7/139
6,308,934 B1 * 10/2001 Gallo ..... 254/25
6,725,486 B2 * 4/2004 Oka ..... 7/127
6,948,700 B2 * 9/2005 Wood ..... 254/25
6,986,504 B1 * 1/2006 Eby et al. ..... 254/25

* cited by examiner

*Primary Examiner*—Lee D Wilson
(74) *Attorney, Agent, or Firm*—Pai Patent & Trademark Law Firm; Chao-Chang David Pai

(57) ABSTRACT

A multipurpose lever type tool is disclosed, which includes a lever head having a thick rear edge for breaking lumber members, a claw, and a handle connected between the head and the claw, the claw having a root obliquely backwardly extending from one end of the handle and a claw body obliquely forwardly extending from the root such that the front end edge of the claw body is substantially in line with the extending line of a side of the handle farthest from the root for safety in use.

6 Claims, 3 Drawing Sheets

MULTIPURPOSE LEVER TYPE TOOL

BACKGROUND OF THE INVENTION (a) Field of the Invention

The present invention relates to hand tools and more particularly to a multipurpose lever type tool, which has a claw curved backwards from one end of the handle thereof and slopes downwardly forwards for safety in use.

(b) Description of the Prior Art

U.S. Pat. No. 4,762,303 discloses a lever type tool entitled "Lumber Turning Tool", which comprises: an elongated handle, and a head having two opposed and spaced apart claws projecting in generally the same direction at opposite sides of a space to closely receive a portion of a rectangular cross section of a lumber member. According to this design, the other end of the handle remote from the head does not have any design for any purpose.

U.S. Ser. Nos. 11/534,612; 11/534,637; 11/534,654, filed by the present inventor, disclose multipurpose tools. These multipurpose tools commonly have a claw at the other end of the handle remote from the head. However, because the claw protrudes over the extending line of one side of the handle at a distance, it may injure the user or a nearby person accidentally.

SUMMARY OF THE INVENTION

The present invention has been accomplished under the circumstances in view. According to one aspect of the present invention, the multipurpose lever type tool comprises a lever head, a claw, and a handle connected between the lever head and the claw. The claw has a root obliquely backwardly extending from one end of the handle and a claw body obliquely forwardly extending from the root such that the front end edge of the claw body is substantially in line with the extending line of a side of the handle farthest from the root for safety in use. Because the claw curves backward and then slopes downwardly forward, it does not protrude over the front side of the handle at a distance, thus preventing potential injury during use. Therefore, the multipurpose lever type tool is safe in use.

According to another aspect of the present invention, the transverse width between the rear side of the root and the front end of the claw body is greater than the width of the handle so that the curved root can be used as a fulcrum when operating the claw to pull a nail. Therefore, the user can use the claw to pull a nail efficiently with less effort.

According to still another aspect of the present invention, the lever head has a thick rear edge for breaking lumber members.

DETAILED DESCRIPTION OF THE PREFERRED EMBODIMENTS

Figure 1:
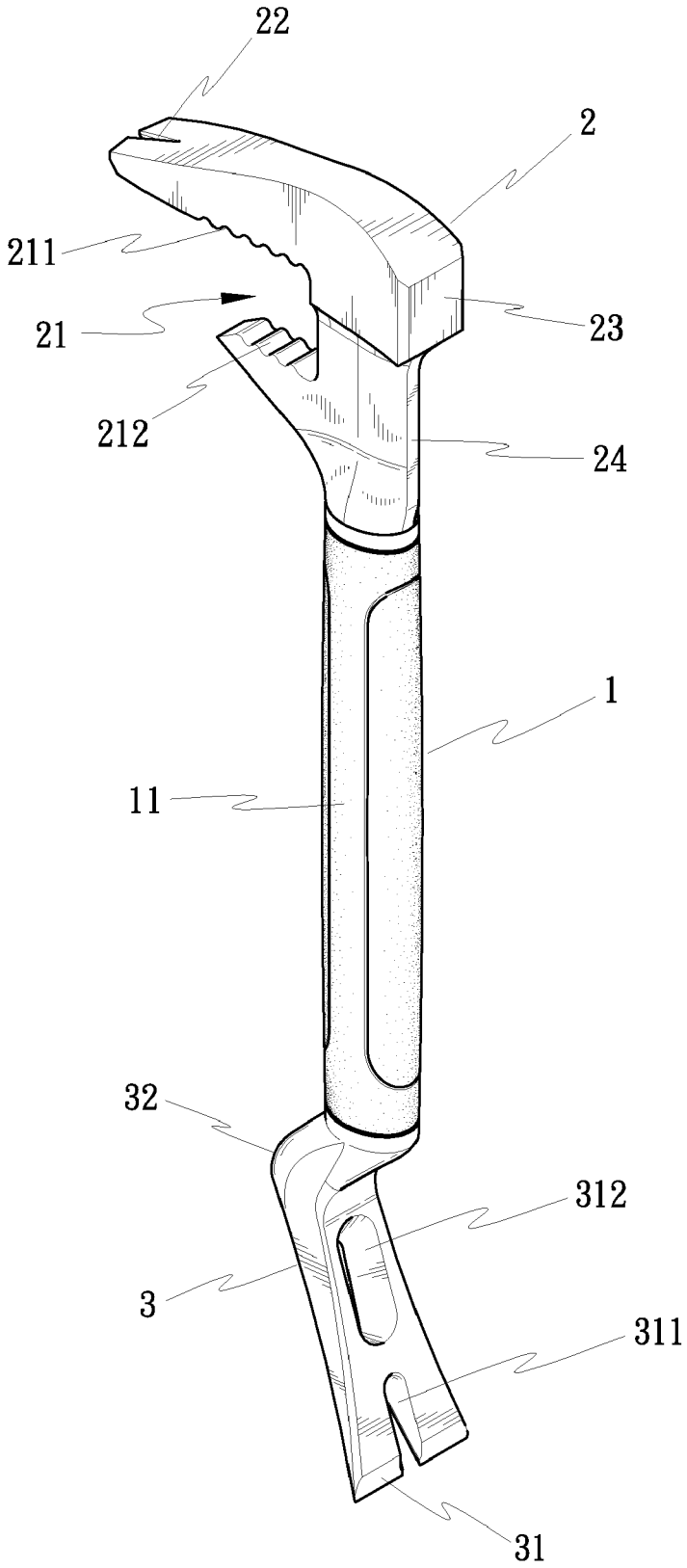
FIG. 1 is an elevational view of a multipurpose lever type tool according to the present invention.

Referring to FIG. 1, a multipurpose lever type tool 1 in accordance with the present invention is shown comprising a head 2, a claw 3, and a handle 1 connected between the head 2 and the claw 3.

The handle 1 is a shaft member having a predetermined length. Further, an anti-slip shaft sleeve 11 is fastened to the periphery of the handle 1 for grasp by hand comfortably and tightly.

Figure 2:
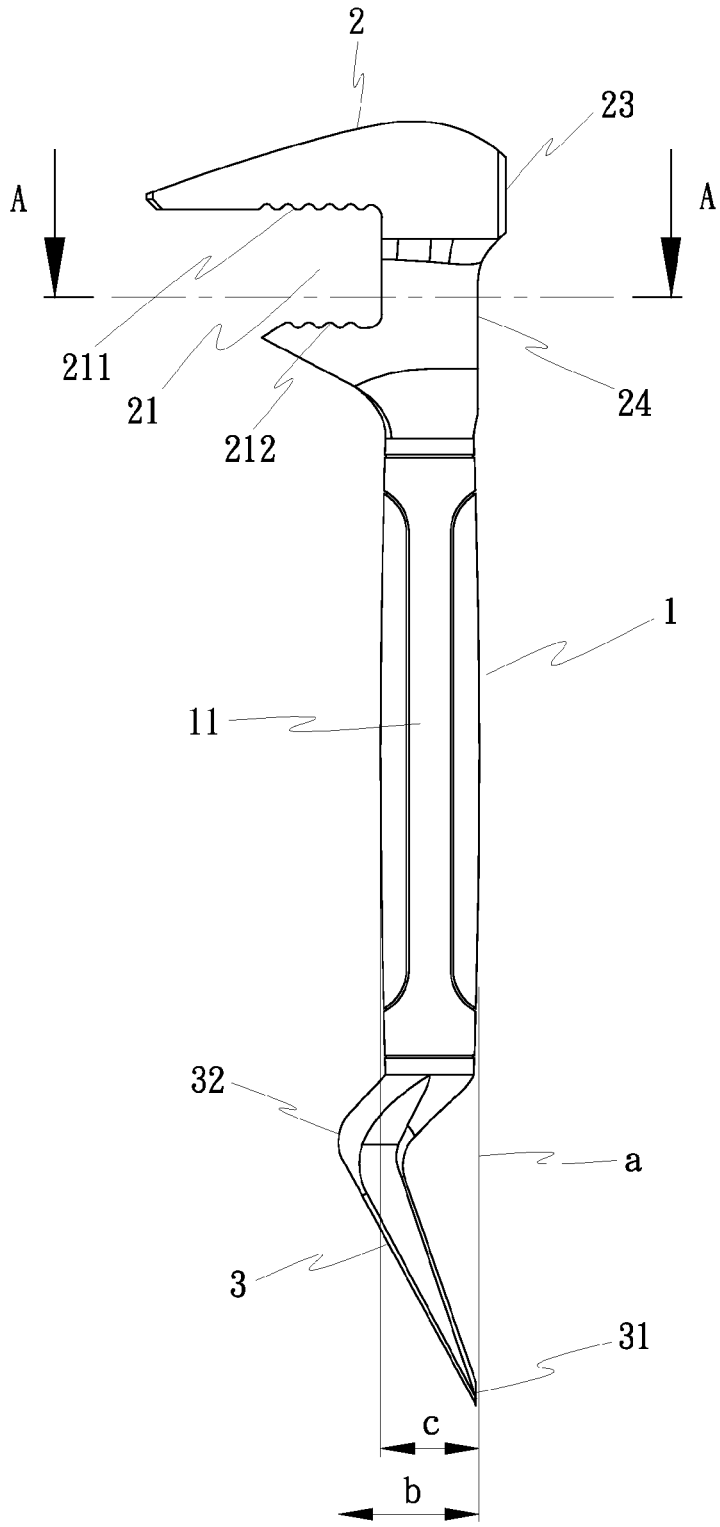
FIG. 2 is a front view of the multipurpose lever type tool according to the present invention.
Figure 3:
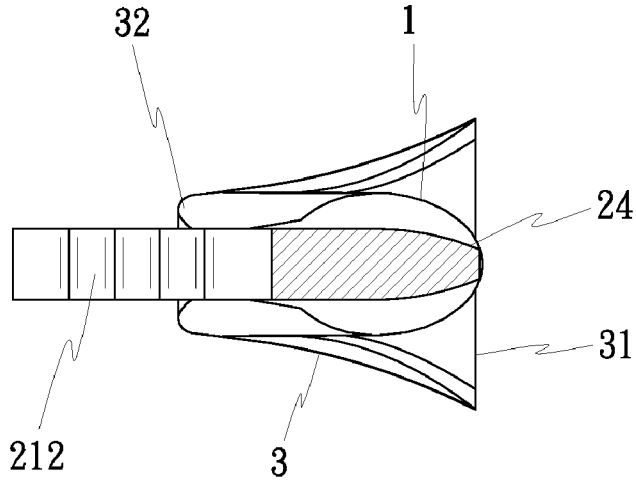
FIG. 3 is a sectional view taken along line A-A of FIG. 2.
Figure 4:
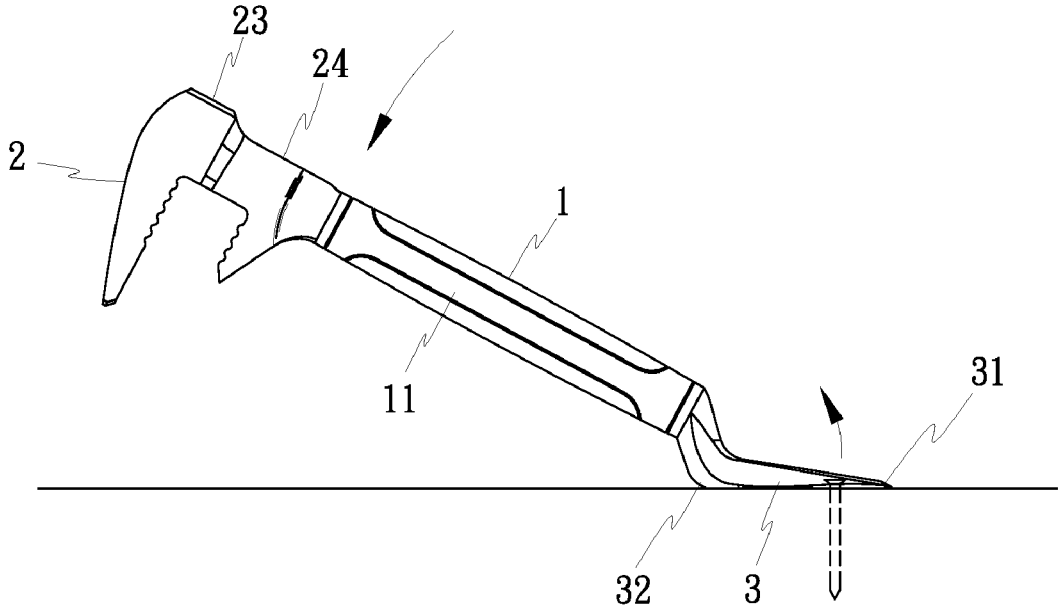
FIG. 4 is a schematic drawing showing an application example of the multipurpose lever type tool according to the present invention.

Referring to FIGS. 2 and 3 and FIG. 1 again, the head 2 has a toothed upper jaw portion 211, a toothed lower jaw portion 212 spaced below the toothed upper jaw portion 211, a mouth 21 defined between the toothed upper jaw portion 211 and the toothed lower jaw portion 212 for securing an object (for example, a lumber member), a claw portion 22 at one end, namely, the front end of the toothed upper jaw portion 211, a hammer face 23 at the other end, namely, the rear end of the toothed upper jaw portion 211 for hammering, and a thick edge 24 at the rear end of the toothed lower jaw portion 212 and spaced below the hammer face 23.

Referring to FIGS. 1~3, the claw 3 has a root 32 obliquely backwardly extending from one end of the handle 1, a claw body 31 obliquely forwardly extending from the root 32, a nail pulling notch 311 on the front end of the claw body 31, and a nail pulling slot 312 cut through top and bottom sides of the claw body 31 and spaced between the nail pulling notch 311 and the root 32. The front edge of the claw body 31 is substantially in line with the extending line "a" of a side of the handle 1 farthest from the root. The transverse width "b" between the rear side of the root 22 and the front end of the claw body 31 is greater than the width "c" of the handle 1.

As stated above, the handle 1, the head 2 and the claw 3 form a multipurpose lever type tool. Because the claw 3 curves backward and then slopes downwardly forward, it does not protrude over the front side of the handle 1 at a distance, thus preventing potential injury during use. Therefore, the multipurpose lever type tool is safe in use.

Further, because the transverse width "b" between the rear side of the root 22 and the front end of the claw body 31 is greater than the width "c" of the handle 1, the curved root 22 works as a fulcrum when the claw 3 is operated to pull a nail. Therefore, the user can use the claw 3 to pull a nail efficiently with less effort.

Further, the thick edge 24 can be used to break lumber members when detaching a wooden construction.

Further, the curving direction of the claw 3 can be designed for left-handed persons. Alternatively, the curving direction of the claw 3 can be designed for right-handed persons. According to this embodiment, the mouth 21 and the claw body 31 of the claw 3 extend in opposite directions. Alternatively, the multipurpose lever type tool can be made such that the mouth 21 and the claw body 31 of the claw 3 extend in the same direction.

Further, the mouth 21 of the head 2 can be made to slope in one direction at an angle about 10°~20°, or preferably 20°. Similar but patentably distinct designs were disclosed in U.S. Ser. Nos. 11/534,612; 11/534,637; 11/534,654 filed by the present inventor.

A prototype of multipurpose lever type tool has been constructed with the features of FIGS. 1~4. The multipurpose lever type tool functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A multipurpose lever type tool comprising a head, a claw, and a handle connected between said head and said claw, wherein said claw has a root obliquely backwardly extending from one end of said handle and a claw body obliquely forwardly extending from said root, said claw body having a front end edge substantially in line with the extending line of a side of said handle farthest from the root;

said claw body has a nail pulling notch on the front end edge thereof, and a nail pulling slot cut through top and bottom sides thereof and spaced between said nail pulling notch and said root; and said head has a toothed upper jaw portion, a toothed lower jaw portion spaced below said toothed upper jaw portion and a mouth defined between said toothed upper jaw portion and said toothed lower jaw portion for securing an object.

2. The multipurpose lever type tool as claimed in claim 1, wherein the transverse width between a rear side of said root and the front end edge of said claw body is greater than the width of said handle.

3. The multipurpose lever type tool as claimed in claim 1, wherein said head has a thick edge at a rear side thereof for breaking lumber members.

4. The multipurpose lever type tool as claimed in claim 1, wherein said head further has a claw portion at a front end of said toothed upper jaw portion, and a hammer face at a rear end of said toothed upper jaw portion for hammering.

5. The multipurpose lever type tool as claimed in claim 1, wherein said mouth of said head and said claw body of said claw extend in opposite directions.

6. The multipurpose lever type tool as claimed in claim 1, wherein said mouth of said head and said claw body of said claw extend in a same direction.

* * * * *